US009970238B2

(12) United States Patent
Gylling

(10) Patent No.: US 9,970,238 B2
(45) Date of Patent: May 15, 2018

(54) METHOD IN PUTTING TOGETHER OF A DOWN-THE-HOLE DRILLING APPARATUS AND A DOWN-THE-HOLE DRILLING APPARATUS

(71) Applicant: Oy Atlas Copco Rotex AB, Tampere (FI)

(72) Inventor: Kai Gylling, Tampere (FI)

(73) Assignee: OY ATLAS COPCO ROTEX AB, Tampere (FI)

( * ) Notice: Subject to any disclaimer, the term of this patent is extended or adjusted under 35 U.S.C. 154(b) by 55 days.

(21) Appl. No.: 14/895,097

(22) PCT Filed: May 15, 2014

(86) PCT No.: PCT/FI2014/050366
§ 371 (c)(1),
(2) Date: Dec. 1, 2015

(87) PCT Pub. No.: WO2015/011336
PCT Pub. Date: Jan. 29, 2015

(65) Prior Publication Data

US 2016/0130879 A1 May 12, 2016

(30) Foreign Application Priority Data

Jul. 26, 2013 (FI) ..... 20135794

(51) Int. Cl.
*E21B 7/20* (2006.01)
*E21B 3/00* (2006.01)
(Continued)

(52) U.S. Cl.
CPC ..... *E21B 7/20* (2013.01); *E21B 3/00* (2013.01); *E21B 10/36* (2013.01); *E21B 17/00* (2013.01);
(Continued)

(58) Field of Classification Search
None
See application file for complete search history.

(56) References Cited

U.S. PATENT DOCUMENTS 3,901,331 A * 8/1975 Djurovic ..... E21B 7/208 175/101
5,150,636 A 9/1992 Hill
(Continued)

FOREIGN PATENT DOCUMENTS

CN 201083085 Y 7/2008
EP 1144797 A1 10/2001
(Continued)

OTHER PUBLICATIONS

PCT/ISA/210—International Search Report—dated Nov. 3, 2014 (Issued in Application No. PCT/FI2014/050366).
(Continued)

*Primary Examiner* — Amber R Anderson
*Assistant Examiner* — Douglas S Wood
(74) *Attorney, Agent, or Firm* — Venable LLP; Jeffri A. Kaminski

(57) ABSTRACT

A method for assembling a down-the-hole drilling apparatus including a drilling device including a casing and a drilling unit arranged during drilling in connection with the casing. The drilling unit includes a drilling head including a drilling arrangement including a first drilling member for drilling a center hole and a second drilling member for reaming the center hole. The drilling members are mutually power transmittingly coupled during drilling to cooperate for rotational, feeding and/or hammering, and removably coupled to enable removal of the first drilling member from a hole. The casing is arranged to be pulled into the hole through a shoulder arranged at an end of the casing. At an opposite end of the drilling arrangement with respect to a drilling surface, is arranged a skirt including a radial internal shoulder for
(Continued)

pulling the casing into the hole by cooperation of the internal shoulder and an external shoulder at the end of the casing.

11 Claims, 8 Drawing Sheets

(51) Int. Cl.

| | |
|---|---|
| ***E21B 10/36*** | (2006.01) |
| ***E21B 19/18*** | (2006.01) |
| ***E21B 17/04*** | (2006.01) |
| ***E21B 17/07*** | (2006.01) |
| ***E21B 17/00*** | (2006.01) |

(52) U.S. Cl.
CPC ..... *E21B 17/04* (2013.01); *E21B 17/076* (2013.01); *E21B 19/18* (2013.01)

(56) References Cited

U.S. PATENT DOCUMENTS

| | | | | |
|---|---|---|---|---|
| 5,590,726 | A | 1/1997 | Jarvela et al. | |
| 5,839,519 | A * | 11/1998 | Spedale, Jr. | E21B 7/208 175/296 |
| 7,182,156 | B2 * | 2/2007 | Charland | E21B 7/20 175/171 |
| 9,174,419 | B2 * | 11/2015 | Utsumi | E04C 2/12 |
| 9,428,964 | B2 * | 8/2016 | Hisada | E21B 7/20 |
| 2003/0038476 | A1 | 2/2003 | Galle et al. | |

FOREIGN PATENT DOCUMENTS

| | | | | |
|---|---|---|---|---|
| EP | 1144797 | B1 | 7/2015 | |
| FI | 95618 | | 11/1995 | |
| FI | 121635 | B | 2/2011 | |
| WO | WO-9529321 | | 11/1995 | |
| WO | WO-2009/007494 | A1 | 1/2009 | |
| WO | 2009/115638 | A1 | 9/2009 | |
| WO | WO-2009115638 | A1 * | 9/2009 | E21B 17/076 |
| WO | WO-2012/049353 | A1 | 4/2012 | |

OTHER PUBLICATIONS

PCT/ISA/237—Written Opinion of the International Searching Authority—dated Nov. 3, 2014 (Issued in Application No. PCT/FI2014/050366).

Supplementary European Search Report issued in corresponding European Patent Application No. 14829014.1 dated Feb. 24, 2017 (11 pages).

* cited by examiner

METHOD IN PUTTING TOGETHER OF A DOWN-THE-HOLE DRILLING APPARATUS AND A DOWN-THE-HOLE DRILLING APPARATUS

CROSS-REFERENCE TO RELATED APPLICATIONS

The application claims priority to Finnish patent application 20135794 filed 26 Jul. 2013 and is the national phase under 35 U.S.C. § 371 of PCT/FI2014/050366 filed 15 May 2014.

FIELD OF THE INVENTION

The invention relates to a method in putting together of a down-the-hole drilling apparatus and a down-the-hole drilling apparatus.

BACKGROUND OF THE INVENTION

A way to carry out down-the-hole drilling in ordinary metal pipe drilling in a deviant manner from traditional asymmetric wing drilling technique is known e.g. from Finnish Patent No. 95618. A drilling head in a drilling unit of the drilling apparatus presented in this patent, existing inside a casing part or in other words a so called earth pipe or casing pipe, is formed of a first frame part and an annular second frame part, the drilling surfaces of which being provided with drilling organs, such as drill bits or like, of the first and second drilling means or in other words of a center drill or a pilot and a reaming drill or a reamer. In this solution the first frame part comprising the first drilling means, is being released from the second frame part comprising the reamer, in order to pull the same alone off from a drilled hole after the drilling situation.

In the solution in question, the second organs of the flushing means for removal of drilling waste being generated are arranged to lead drilling waste by means of an assembly, which locks the said drilling means together for a drilling situation unrotatively in respect with each other and in both directions longitudinally, which is in other words carried out as an advantageous embodiment by loosening grooves of a bayonet coupling, being placed longitudinally on a side surface of the first frame part.

In connection with a drilling device of the type described above, typically a casing shoe is being used at the end of the casing part, by means of which the casing part is pulled into the hole to be drilled by a power influence (F) that is directed to the casing shoe either from the pilot or the reamer. E.g. in FIG. 3 presenting prior art, the power influence pulling the casing part into the hole is transmitted by counterparts in the casing shoe (8) and the pilot. In the implementation in question, there has been exploited furthermore screw joint principle in the binding means (L) connecting the casing shoe and the reamer in a way that the parts in question can be coupled with each other in a lockable manner in the longitudinal direction by a screw joint, whereby the parts in question stay axially together though the mutual bayonet locking between the pilot and the reamer is opened. Respectively in FIGS. 1 and 2 presenting prior art there has been presented for their part structures, in which the casing part is being pulled through binding means between the casing shoe and the reamer that is by one or in the longitudinal direction two pulling shoulder assemblies one after the other in the parts in question.

Furthermore e.g. from patent EP 1144797 it is known to exploit a so called shrinking method in forming of the binding means between a casing shoe and a rotationally symmetrical drill, in which case the casing shoe is being pressed radially in a way that a locking projection therein gets coupled with a corresponding locking recess in the drill. This kind of a mounting requires high power in order to carry out the press binding, which is why the method in question is applicable usually for coupling of structures, having a maximum outer diameter of 300 mm.

Putting together of a drilling head according to FIG. 1 takes place typically so that an essentially elongated, in a manner of speaking sleeve-like, casing shoe is being cut during a mounting phase in a machine shop longitudinally at one point and spread open, whereafter it is being pressed together over the reamer. After this, it is being welded by its cutting point back to form once again as a uniform ring. The most remarkable disadvantage of this kind of a structure, being welded together, is the weak point due to the welding seam in the casing shoe, which gets very easily broken under difficult circumstances. A further disadvantage of this solution are thus those "extra" working phases related thereto, because the casing shoe must first of all be cut longitudinally, pressed onto the reamer and finally once again welded together. The drilling device according to FIG. 2 is being put together by the shrinking method explained above that is by pressing and the one shown in FIG. 3 by using a screw joint, in which case the screw joint does not, however, carry load during drilling.

Furthermore particularly applications for use of so called plastic pipe drilling typically e.g. well drilling or e.g. forepoling come into question. An advantage of use of a plastic pipe in drilling is first of all the fact that plastic pipes are very light compared to steel pipes, thanks to which they also have more profitable transport costs and they are easier to handle at a construction site. Furthermore a plastic pipe is significantly cheaper than a corresponding steel pipe. A plastic pipe does not rust for that matter and when being mounted into the ground, it does not break the bits of crushers or drills, when the soil is later on being e.g. worked or drilled. Furthermore in caves or quarries, metal may not blend with broken rocks, which is why use of plastic pipes in drilling has a very remarkable meaning in that context as well.

Today significant problems are, however, related to plastic pipe drilling, which is why it is not possible to exploit the same to the extent that there is a need for or that there are possibilities in practice. This is among other things due to the fact that the present arrangements require first of all use of a steel pipe in the beginning of drilling, whereby it is only after that possible to start using in the drilling a plastic pipe to be coupled with the steel pipe e.g. by a screw joint and after that further plastic pipes to be coupled with each other one after the other. On the other hand solutions are being used, which are based on a screw joint coupling between a plastic pipe with a readymade threading and a casing shoe.

The former solution is not satisfactory first of all due to the fact that there is still a need for use of a steel pipe in the starting phase, whereby it is possible to exploit plastic pipes with preworked threadings only after the above phase. On the other hand use of plastic pipes with readymade threadings has, however, found out to be also very difficult in practice, because a threaded part of a plastic pipe being coupled with a casing shoe made of steel easily gets cut, due to differences in shapes of mutual threadings in the parts in question. The problems related to preworked threadings in plastic pipes are probably due to the differences of steel and plastic e.g. because of strength and thermal expansion characteristics thereof and the like reasons.

There have been efforts for further development of joint arrangements in plastic pipes with readymade threadings e.g. by using first of all a coupling part coupled with the plastic pipe with a screw joint and on the other hand a very long coupling stem in the casing shoe with necessary elasticity means, such as damping O-rings, despite of which a screw joint between a casing shoe and a plastic pipe to be carried out with reasonable costs has not been managed to reliably accomplish so far. All the types of arrangements described above require unnecessarily massive arrangements in carrying out a screw joint between the casing shoe and the plastic pipe, which is why they increase the manufacturing costs disproportionately and make use of the solutions in question significantly more difficult in practical installation work.

Particularly for the part of a drilling apparatus comprising a rotationally symmetrical pilot and a reamer, there has been found a further need for development of its construction particularly due to the problems related to use of a traditional casing shoe with a view both to metal and plastic pipe drilling, because the type of solutions described above for the mutual coupling of a drilling unit and a casing part by using a casing shoe have been found unsatisfactory.

SUMMARY OF THE INVENTION

It is an aim of the present method and the down-the-hole drilling apparatus to achieve a decisive improvement particularly for the putting together of the type of down-the-hole drilling apparatus described above and thus to raise essentially the level of prior art.

As the most important advantages of the method and the down-the-hole drilling apparatus according to the invention may be mentioned simplicity of constructions and operating principles enabled by the same first of all thanks to the fact that the functionality of the rotationally symmetrical drilling apparatus, being found profitable in practice as such, can be further improved, because thanks to the invention it is possible to make particularly the mounting phases related to the putting together of a drilling unit more efficient and to significantly decrease material consumption. The above is particularly thanks to the fact that there is no more need for use a traditional casing shoe, but instead the drilling unit can be coupled in a machine shop in a preliminary working phase to be coupled, as an advantageous embodiment as a separate part, with the end of the casing part, which for its part can be coupled with traditional arrangements as such furthermore in connection with the end of the casing part endways or e.g. partly in an overlapping manner e.g. by flash welding, spot welding, gluing, or by mechanical arrangements, such as by a screw, cotter pin, snap lock joint or correspondingly etc.

A further crucial advantage of the invention is furthermore the fact that it enables increasing the efficiency of production with a view to both traditional metal pipe drilling and plastic pipe drilling. A coupling between the reamer and the casing part, being produced according to the invention, can be carried out by exploiting shrinking technique more efficiently than before and when needed even with bigger dimensions than the solutions described in the beginning, particularly thanks to the simple structure of the reamer's skirt part, in which case the wall thicknesses thereof can be minimized when compared to traditional casing shoe constructions. By virtue of the invention, in the coupling between the drilling unit and the casing part, disproportionately high use of power is thus not required, thanks to the invention enabling on the first hand savings in materials thanks to the functioning of the casing shoe being integrated in the reamer and on the other hand the putting together getting more efficient thanks to avoiding the mounting phases due to the longitudinal cutting of the casing shoe.

Other advantageous embodiments of the method and the down-the-hole drilling apparatus according to the present invention have been presented below.

BRIEF DESCRIPTION OF THE DRAWINGS

In the following description the invention is being illustrated in detail with reference to the appended drawings, in which in FIG. 1 is shown as a longitudinal cross-sectional view an implication according to prior art related to metal pipe drilling, in which the mutual jointing means of the casing shoe and the reamer are arranged by two successive pulling shoulders in the longitudinal direction in the parts in question, in FIG. 2 is shown as a longitudinal cross-sectional view an implication according to prior art related to metal pipe drilling, in which the jointing means between the casing shoe and the reamer are carried out by one pulling shoulder in each, in FIG. 3 is shown as a longitudinal cross-sectional view an implication according to prior art related to metal pipe drilling, in which the jointing means between the casing shoe and the reamer are carried out by a screw joint and, in which pulling of the casing part into the hole takes place by shoulders between the pilot and the casing shoe, in FIG. 4 is shown as a longitudinal cross-sectional view an advantageous reamer manufactured according to the invention after manufacturing thereof prior to pressing thereof and mounting of the pilot in its place, in FIG. 5 is shown as a longitudinal cross-sectional view the coupling of the reamer according to FIG. 4 as a further advantageous embodiment with an extension part to be coupled with the end of the casing part, in FIG. 6 is shown as a longitudinal cross-sectional view a composition according to FIG. 4, being pressed together, in which the pilot has been placed in its place, in FIG. 7 is shown a longitudinal cross-sectional view a further advantageous composition, being carried out according to the invention, of an external shoulder arrangement in connection with the reamer and the end of the casing part, and in FIG. 8 is shown furthermore as a longitudinal cross-sectional view an advantageous composition according to the invention of the reamer and the end of the casing part.

DETAILED DESCRIPTION OF EMBODIMENTS OF THE INVENTION

Figure 1:
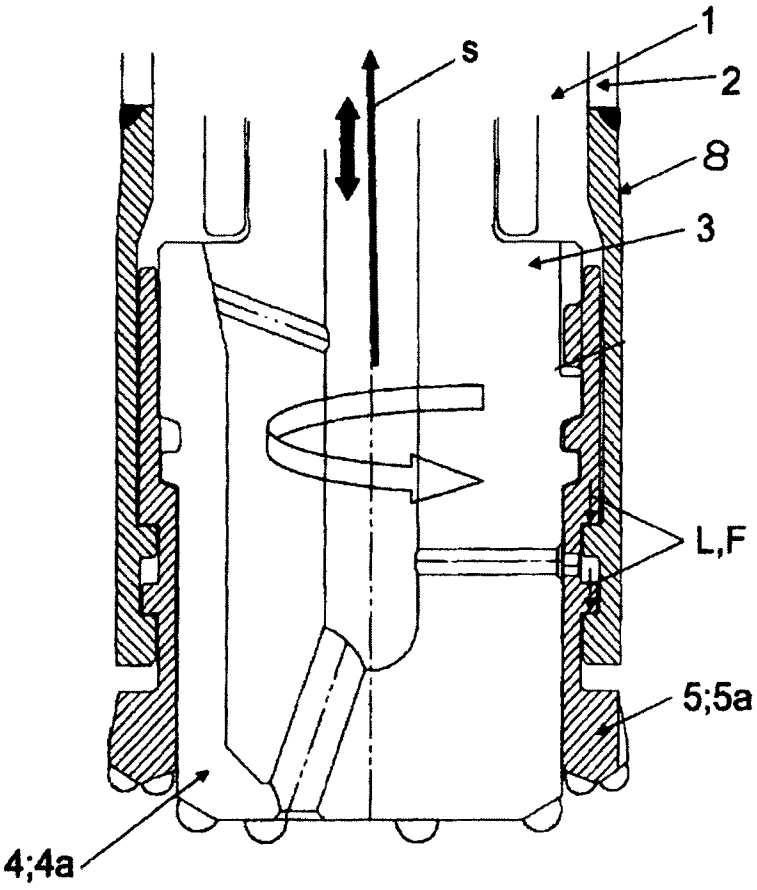
FIG 1. PRIOR ART
Figure 2:
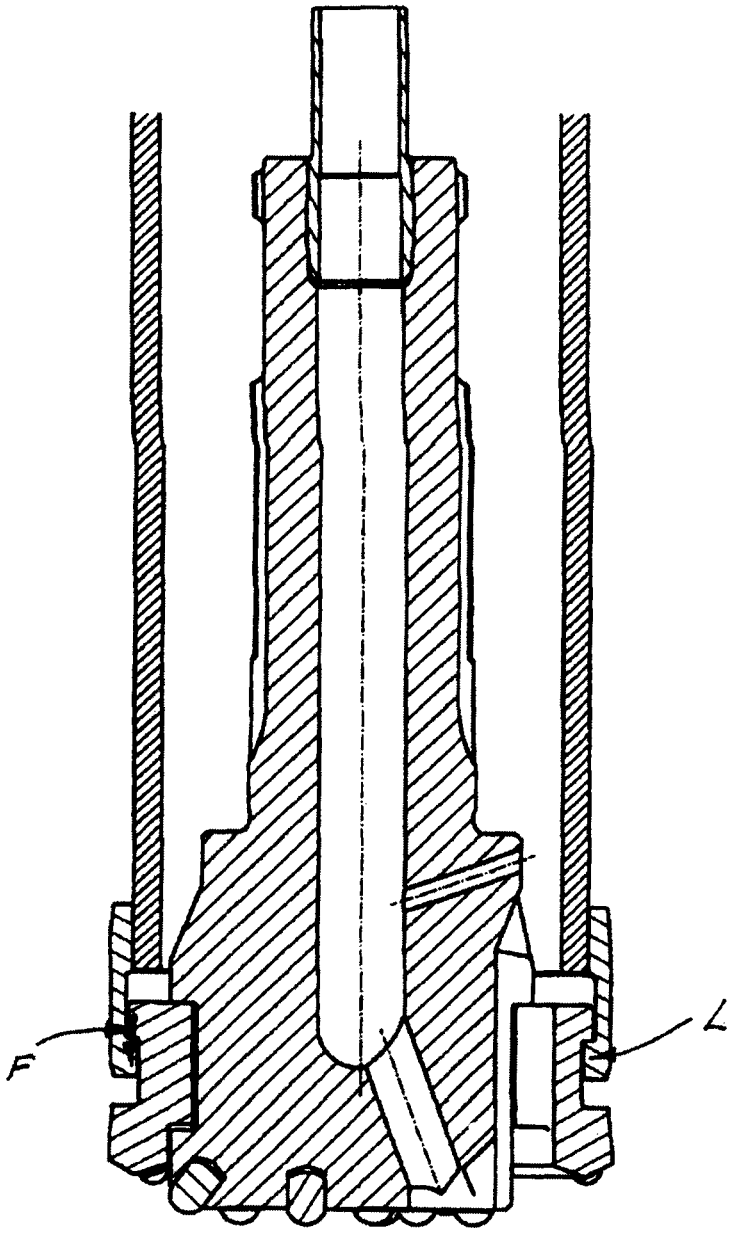
FIG. 2 PRIOR ART
Figure 3:
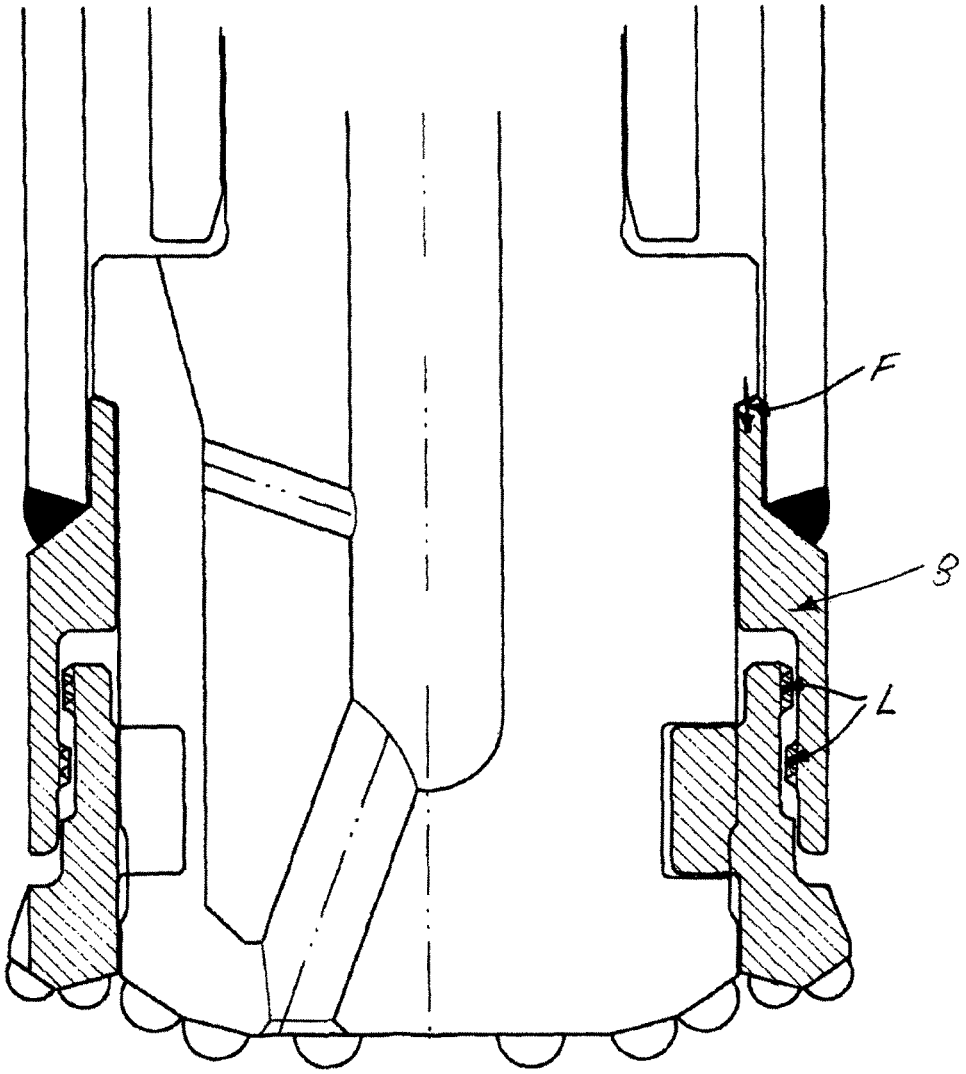
Fig. 3 PRIOR ART

The invention relates first of all to a method in putting together of a down-the-hole drilling apparatus, which apparatus has a drilling device 1 that consists of a casing part 2 and a drilling unit 3 existing at least during a drilling situation in connection with the above, which drilling unit includes in its drilling head a drilling arrangement, such as first drilling means 4 for drilling a center hole and second drilling means 5 for reaming the center hole for the casing part 2, the drilling means 4, 5 being coupled on the first hand at least during a drilling situation mutually in a power transmitting manner in order to carry out co-operation thereof for a rotational motion, a feeding motion and/or a hammering motion, and on the other hand removably in connection with the casing part 2 in order to enable at least removal of the first drilling means 4 from a drilled hole. The casing part 2 is arranged to be pulled into the hole to be drilled by a power influence directed thereto from the drilling unit 3 through a shoulder arrangement being arranged at an end of the casing part. At an opposite end II of the drilling arrangement, such as the second drilling means 5, with respect to a drilling surface P of the drilling unit 3, there has been arranged e.g. as shown in FIG. 4 a built-in skirt part z, which has in radial direction r an internal shoulder arrangement x for pulling the casing part 2 into the hole to be drilled by co-operation of the said internal shoulder arrangement x and the external shoulder arrangement y being arranged at the end I of the casing part.

Figure 4:
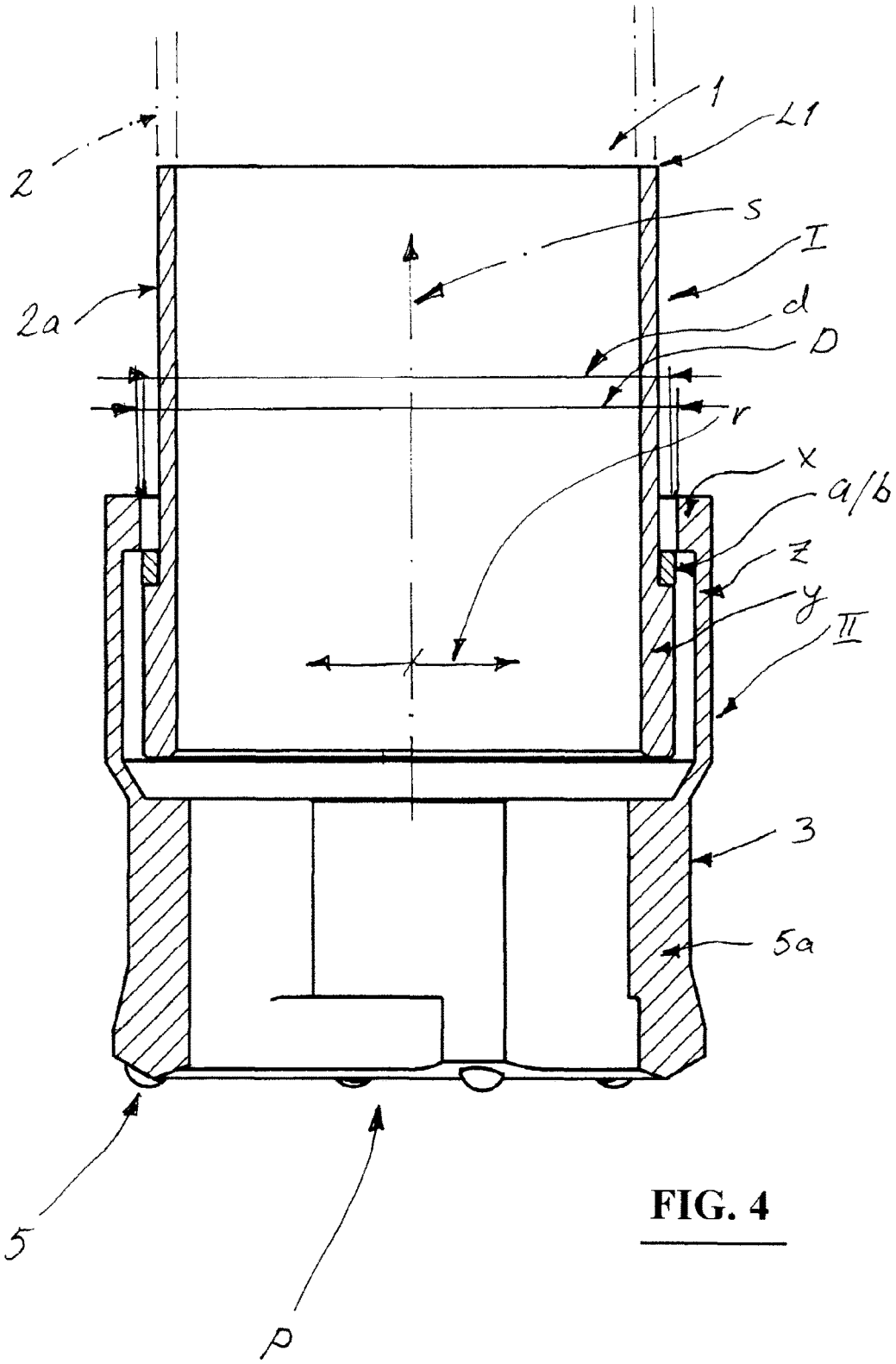
Figure 5:
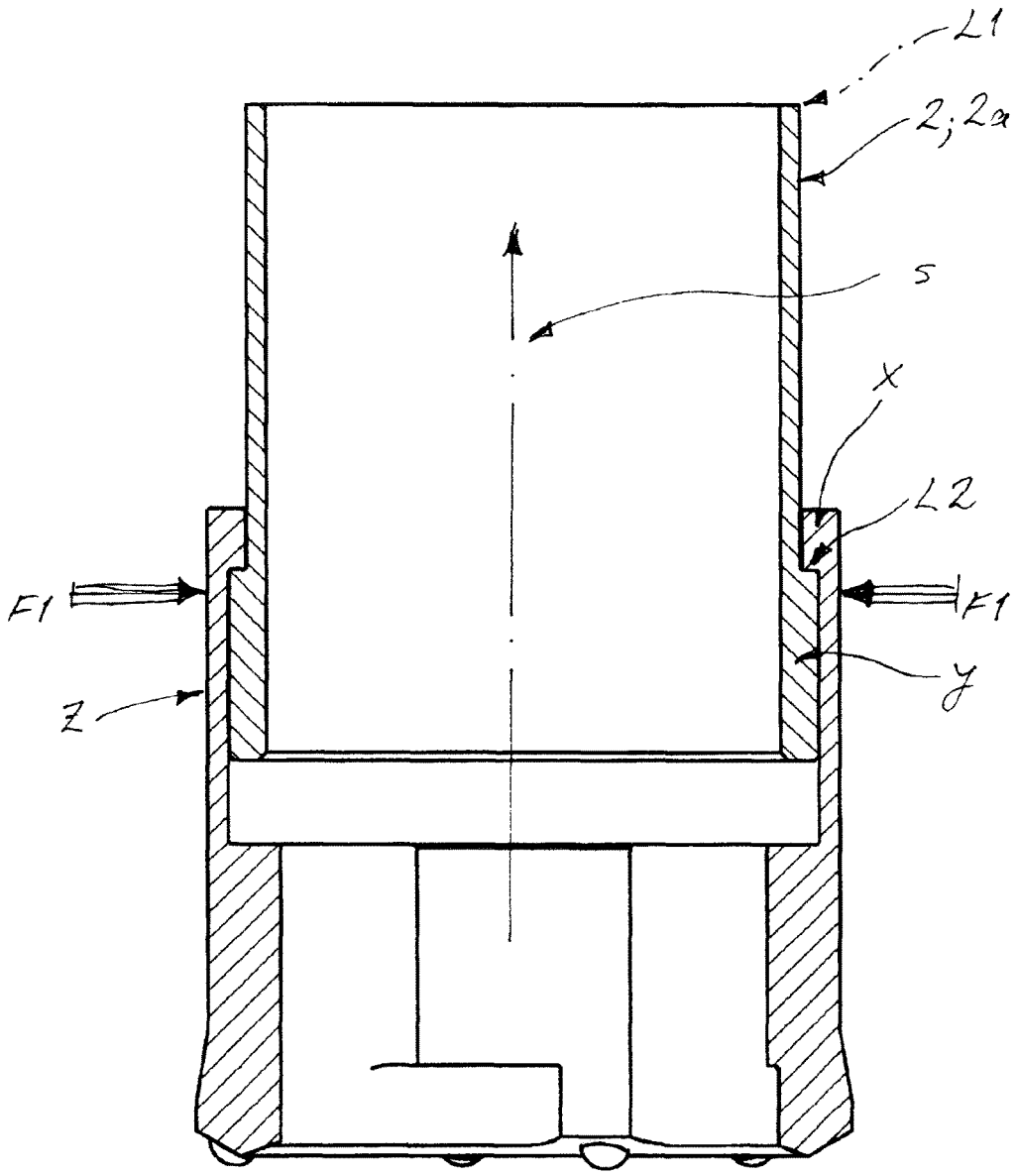

In the method according to the invention the internal shoulder arrangement x in connection with the second drilling means 5, such as an internal flange at an end of the skirt part z, is being manufactured e.g. on the principle that manifests itself in FIG. 4 by its inner diameter D essentially larger than the outer diameter d of the corresponding external shoulder arrangement y of the casing part 2, such as a cantilever flange at an end thereof, whereby a mutual joint L2 between the parts in question that transmits pulling in longitudinal direction s is being formed on the principle that manifests itself in FIG. 5 by placing the shoulder arrangements x, y, being put on top of each other, to overlap one another and by shrinking F1 the internal shoulder arrangement x in the longitudinal direction s behind the external shoulder arrangement y.

Figure 6:
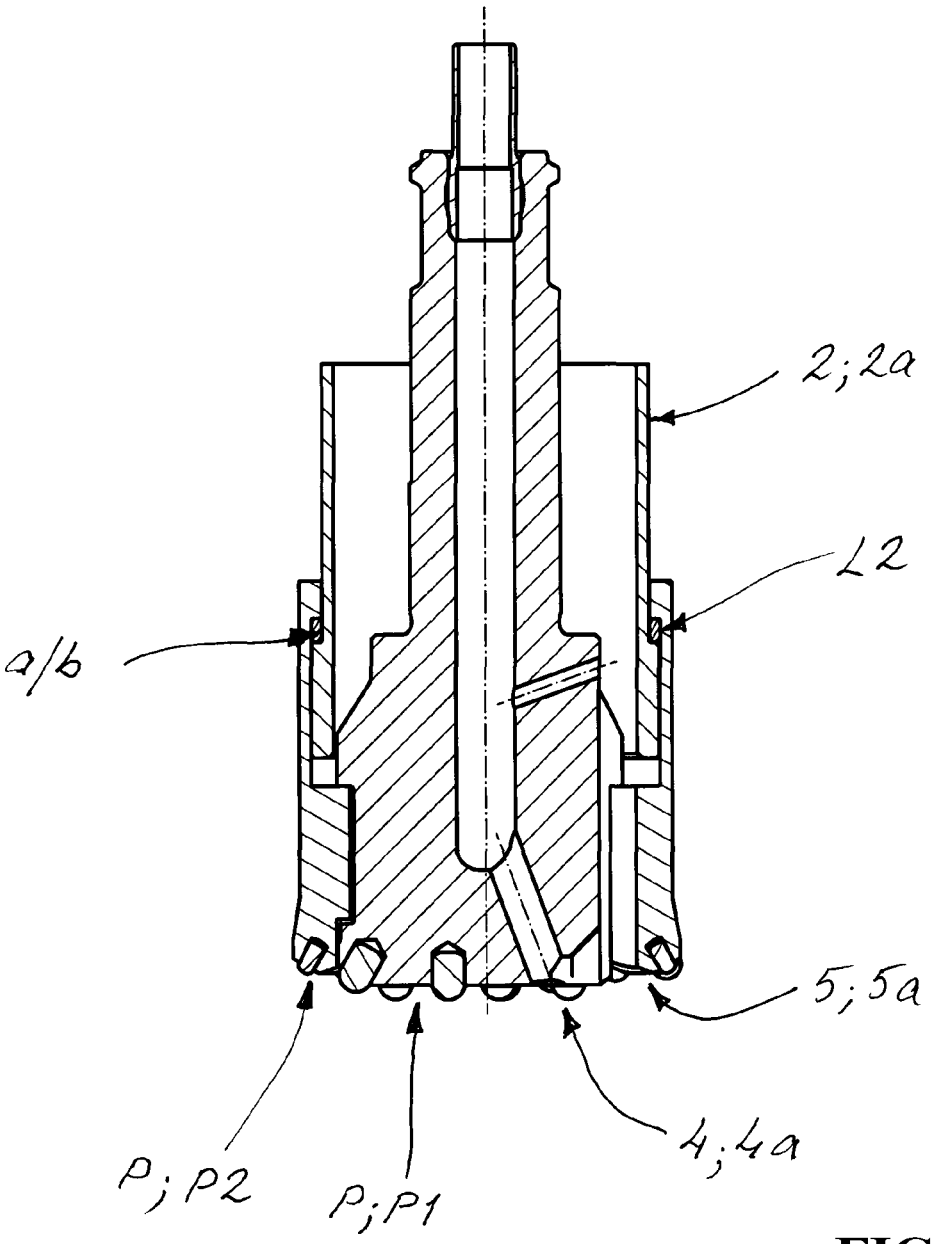

As an advantageous embodiment of the method according to the invention particularly with reference to FIG. 6 the drilling head of the drilling unit 3 is formed of a first frame part 4*a* and a second frame part 5*a*, wherein drilling surfaces P; P1, P2 formed of end surfaces of the above frame parts are provided with drilling organs of the first and the second drilling means 4, 5, such as an integrated drilling part, separate drilling pieces, bits or like. Furthermore particularly with reference to FIG. 4 at the end of the casing part 2 is being arranged an extension part to be fastened thereto separately and that is equipped with a shoulder arrangement. The extension part 2*a* is being coupled with the end of the casing part 2 by what ever suitable e.g. mechanical joint arrangement L1, chemical joint arrangement L1 and/or joint arrangement L1 based on melting.

As a further advantageous embodiment of the method according to the invention, in plastic pipe drilling, as the casing part 2 an essentially unpreworked raw pipe preform is being used, which is manufactured particularly for food stuff utilization preferably from PEH-, PVC-plastic or the like and/or from reinforced plastic, such as fibre-reinforced plastic or the like.

Furthermore as an advantageous embodiment of the method according to the invention particularly with reference to FIGS. 4 and 6 in the longitudinal direction s between the shoulder arrangements x, y is being placed (e.g. by pushing in its place from behind prior to radial pressing together of the skirt part z) at least one wear/slide ring a particularly in order to minimize thermal influence directed to the external shoulder arrangement y. What is meant by the above in practise is that e.g. a wear/slide ring a made of e.g. plastic, metal, composite and/or ceramic material acts as a slide surface for the internal shoulder arrangement x, in which case heat or wear is not directed to the external shoulder arrangement y.

Figure 7:
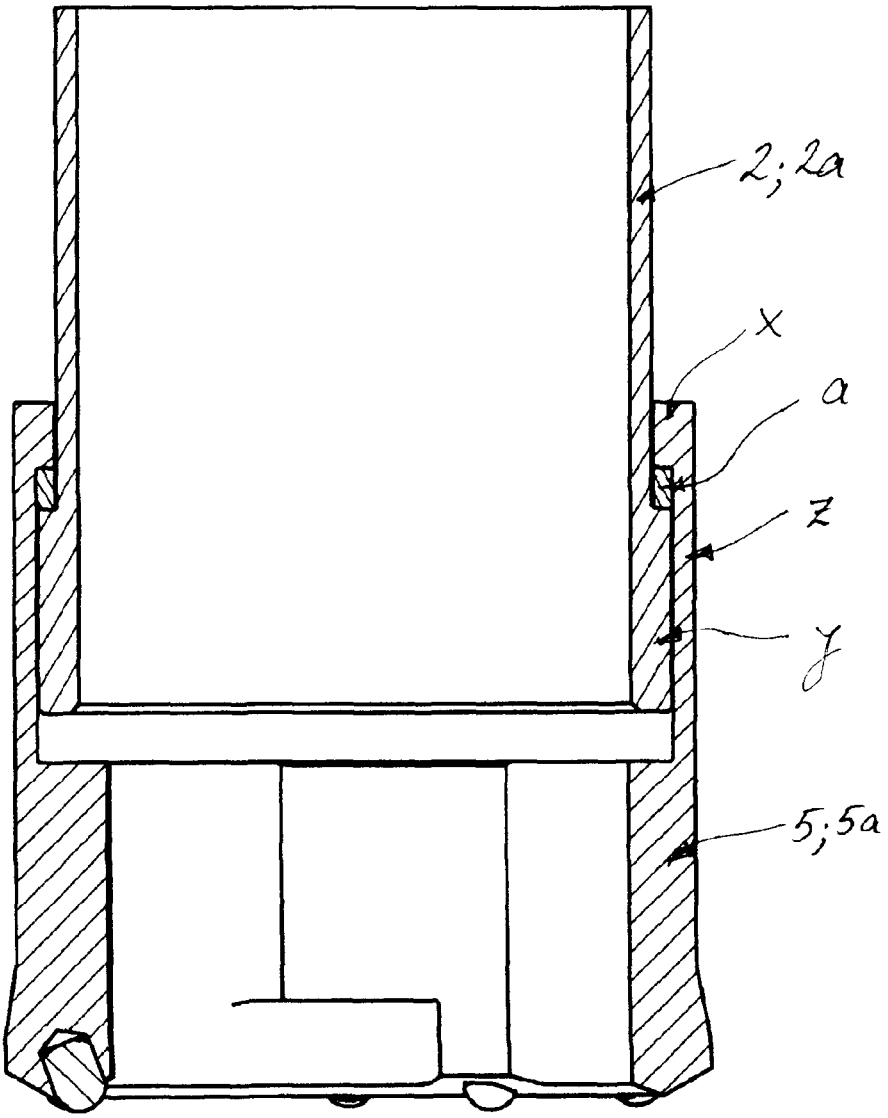
Figure 8:
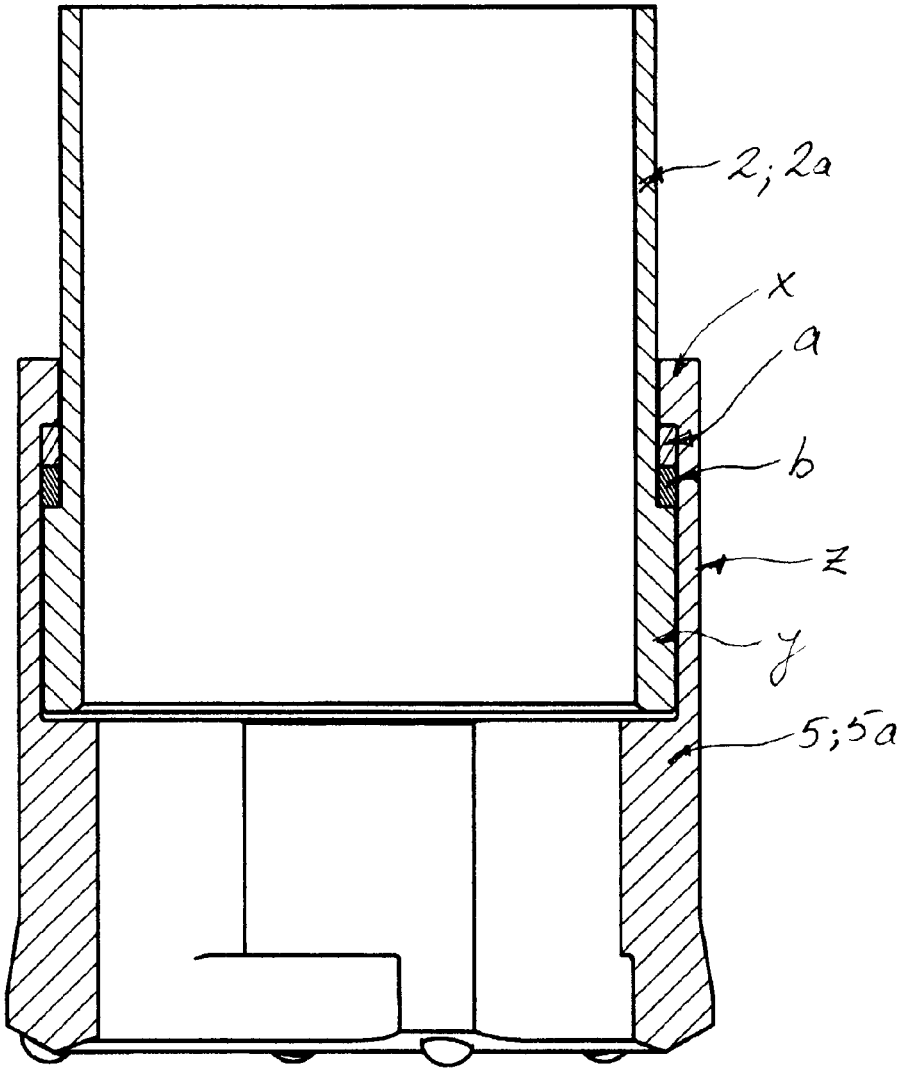

Depending on e.g. drilling circumstances at any given time, with reference particularly to FIG. 7 as a further advantageous embodiment as an alternative to the above mentioned or as an advantageous complementary embodiment, in the longitudinal direction s between the shoulder arrangements x, y is being placed at least one elastic/friction ring b particularly in order to minimize impact and thermal influence directed to the external shoulder arrangement y. What is meant by the above in practise is that the elastic/friction ring above e.g. made of elastic plastic, rubber, silicon and/or the like material and that is placed advantageously directly against the external shoulder arrangement y absorbs e.g. vibration directed to the external shoulder arrangement from a hammering motion and eliminates rotative motion taking place against it, in which case excessive heating thereof can be avoided.

The invention relates on the other hand to a down-the-hole drilling apparatus, which has a drilling device 1 that consists of a casing part 2 and a drilling unit 3 existing at least during a drilling situation in connection with the above, which drilling unit includes in its drilling head a drilling arrangement, such as first drilling means 4 for drilling a center hole and second drilling means 5 for reaming the center hole for the casing part 2, the drilling means 4, 5 being coupled on the first hand at least during a drilling situation mutually in a power transmitting manner in order to carry out co-operation thereof for a rotational motion, a feeding motion and/or a hammering motion, and on the other hand removably in connection with the casing part in order to enable at least removal of the first drilling means 4 from a drilled hole. The casing part 2 is arranged to be pulled into the hole to be drilled by a power influence directed thereto from the drilling unit 3 through a shoulder arrangement being arranged at an end of the casing part. At an opposite end II of the drilling arrangement, such as the second drilling means 5, with respect to a drilling surface P of the drilling unit 3, there has been arranged e.g. on the principle shown in FIG. 4 a built-in skirt part z, which has in radial direction r an internal shoulder arrangement x for pulling the casing part 2 into the hole to be drilled by co-operation of the said internal shoulder arrangement x and the external shoulder arrangement y being arranged at the end I of the casing part.

In the down-the-hole drilling apparatus according to the invention, an inner diameter D of the internal shoulder arrangement x in connection with the second drilling means 5, such as an internal flange at an end of the skirt part z, is essentially larger than the outer diameter d of the corresponding external shoulder arrangement y of the casing part 2, such as a cantilever flange at an end thereof, in order to form a mutual joint L2 between the parts in question that transmits pulling in longitudinal direction s on the principle shown in FIG. 5 by placing the shoulder arrangements x, y, being put on top of each other, to overlap one another and by shrinking F1 the internal shoulder arrangement x in the longitudinal direction s behind the external shoulder arrangement y.

As an advantageous embodiment of the down-the-hole drilling apparatus according to the invention, the drilling head of the drilling unit 3 is formed of a first frame part 4*a* and a second frame part 5*a*, wherein drilling surfaces P; P1, P2 formed of end surfaces of the above frame parts are provided with drilling organs of the first and the second drilling means 4, 5, such as an integrated drilling part, separate drilling pieces, bits or like, and, whereby at the end of the casing part 2 is arranged an extension part to be fastened thereto separately and that is equipped with a shoulder arrangement. The extension part 2*a* provided with an external shoulder arrangement y is coupled with the end of the casing part 2 e.g. by a mechanical joint arrangement L1, chemical joint arrangement L1 and/or a joint arrangement L1 based on melting.

As a further advantageous embodiment of the down-the-hole drilling apparatus according to the invention, in plastic pipe drilling the casing part 2 is an essentially unpreworked raw pipe preform, which is manufactured particularly for food stuff utilization preferably from PEH-, PVC-plastic or the like and/or from reinforced plastic, such as fibre-reinforced plastic or the like. Furthermore, in the longitudinal direction s between the shoulder arrangements x, y, is arranged with reference to the advantageous embodiment shown in FIGS. 4, 6 and 7 at least one:

wear/slide ring a particularly in order to minimize thermal influence directed to the external shoulder arrangement y, and/or elastic/friction ring b particularly in order to minimize impact and thermal influence directed to the external shoulder arrangement y.

It is clear that the invention is not limited to the embodiments shown or described above, but instead it can be modified within limits of the basic idea of the invention according to the needs and circumstances, such as the drilling site, at any given time. It is thus clear, that the constructions of the drilling devices being illustrated in the appended drawings may vary in practice very much merely when being carried out with differing diameters. Instead of the type of embodiments shown e.g. in the appended drawings, it is naturally possible to use as the drilling device also other drilling devices that are applicable for the same purpose, in which a casing part is being exploited in connection with the drilling that is being drawn into the ground most profitably unrotatively. It is not that significant for the method and the apparatus according to the invention, either, how the first and second drilling means are coupled to work, so that most heterogeneous solutions can be exploited as the power transmission assemblies between the same particularly thanks to the "external" functioning of the flushing flow with respect to the fastening arrangement starting from a screw joint locking. The invention is naturally applicable for use of a single part drilling device, which in that case does not have a separate reamer and pilot.

The invention claimed is:

1. A method for assembling a down-the-hole drilling apparatus, the apparatus comprising a drilling device comprising a casing and a drilling unit the drilling unit comprising a drilling head comprising a drilling arrangement, the drilling arrangement comprising a first drilling member configured to drill a center hole and a second drilling member configured to ream the center hole for the casing, the first drilling member and the second drilling member being coupled at least during drilling mutually in a power transmitting manner in order to cooperate for at least one of a rotational motion, a feeding motion or a hammering motion, and removably coupled in connection with the casing to enable at least removal of the first drilling member from a drilled hole, whereby the casing is arranged to be pulled into the hole to be drilled by the drilling unit through a shoulder arrangement arranged at an end of the casing, and, whereby at an opposite end of the drilling arrangement with respect to a drilling surface of the drilling unit is arranged a built-in skirt, the skirt comprising in a radial direction an internal shoulder arrangement for pulling the casing into the hole to be drilled by co-operation of the internal shoulder arrangement and the external shoulder arrangement being arranged at the end of the casing, the method comprising:

manufacturing the internal shoulder arrangement in connection with the second drilling member to have an inner diameter larger than the outer diameter of the corresponding external shoulder arrangement of the casing;

forming a mutual joint between the second drill member and the casing that transmits a pulling force in a longitudinal direction by placing the shoulder arrangements on top of each other, to overlap one another, the internal shoulder arrangement in the longitudinal direction behind the external shoulder arrangement, and by shrinking the internal shoulder arrangement in a shrinkable skirt part of the second drill member in order to diminish its inner diameter smaller than the outer diameter of the external shoulder arrangement.

2. The method according to claim 1, wherein when using an apparatus, in which the drilling head of the drilling unit is formed of a first frame part and a second frame part, wherein drilling surfaces formed of end surfaces of the above frame parts are provided with drilling organs of the first drilling member and the second drilling member, whereby at the end of the casing is being arranged an extension part to be fastened thereto separately and that is equipped with a shoulder arrangement, the method further comprising:

coupling the extension part comprising an external shoulder arrangement with the end of the casing with at least one of a mechanical joint arrangement, a chemical joint arrangement or a joint arrangement based on melting.

3. The method according to claim 1, further comprising:

using in plastic pipe drilling, as the casing an unpreworked raw pipe preform, which is manufactured particularly for food stuff utilization.

4. The method according to claim 3, further comprising:

placing in the longitudinal direction between the shoulder arrangements at least one wear/slide ring to minimize thermal influence directed to the external shoulder arrangement.

5. The method according to claim 3, further comprising:

placing in the longitudinal direction between the shoulder arrangements at least one elastic/friction ring to minimize impact and thermal influence directed to the external shoulder arrangement.

6. A down-the-hole drilling apparatus comprising:

a drilling device comprising a casing and a drilling unit arranged at least during drilling in connection with the casing, the drilling unit comprising a drilling head comprising a drilling arrangement, the drilling arrangement comprising a first drilling member configured to drill a center hole and a second drilling member configured to ream the center hole for the casing, the first drilling member and the second drilling member being coupled at least during drilling mutually in a power transmitting manner to cooperate for at least one of a rotational motion, a feeding motion or a hammering motion, and removably coupled in connection with the casing to enable at least removal of the first drilling member from a drilled hole, whereby the casing is arranged to be pulled into the hole to be drilled by the drilling unit through a shoulder arrangement arranged at an end of the casing, and, whereby at an opposite end of the drilling arrangement with respect to a drilling surface of the drilling unit is arranged a built-in skirt part comprising in a radial direction an internal shoulder arrangement for pulling the casing part into the hole to be drilled by co-operation of the internal shoulder arrangement and the external shoulder arrangement arranged at the end of the casing, wherein the second drilling member and the casing are coupled with a shrink joint, in which the internal shoulder arrangement is placed in the longitudinal direction behind the external shoulder arrangement that exists in a shrinkable skirt part of the second drill member.

7. The apparatus according to claim 6, wherein the drilling head of the drilling unit comprises a first frame part and a second frame part, wherein drilling surfaces formed of end surfaces of the above frame parts comprise drilling organs of the first drilling member and the second drilling member, and whereby at the end of the casing is arranged an extension part to be separately fastened to the casing and that comprises a shoulder arrangement, wherein the extension part comprising the external shoulder arrangement is coupled with the end of the casing by at least one of a mechanical joint arrangement, chemical joint arrangement or a joint arrangement based on melting.

8. The apparatus according to claim 6, wherein in plastic pipe drilling the casing comprises an unpreworked raw pipe preform, which is manufactured particularly for food stuff utilization.

9. The apparatus according to claim 8, wherein in the longitudinal direction between the shoulder arrangements is arranged at least one wear/slide ring to minimize thermal influence directed to the external shoulder arrangement.

10. The apparatus according to claim 8, wherein in the longitudinal direction between the shoulder arrangements is arranged at least one elastic/friction ring to minimize impact and thermal influence directed to the external shoulder arrangement.

11. The method according to claim 3, wherein the unpreworked raw pipe preform is manufactured from at least one of PEH, PVC or reinforced plastic.

* * * * *